US011823608B2

(12) United States Patent
Jee et al.

(10) Patent No.: US 11,823,608 B2
(45) Date of Patent: Nov. 21, 2023

(54) DISPLAY DEVICE AND DRIVING METHOD THEREOF

(71) Applicant: SAMSUNG DISPLAY CO., LTD., Yongin-si (KR)

(72) Inventors: Ahn Ho Jee, Yongin-si (KR); Sang Woo Park, Yongin-si (KR)

(73) Assignee: SAMSUNG DISPLAY CO., LTD., Gyeonggi-Do (KR)

( * ) Notice: Subject to any disclaimer, the term of this patent is extended or adjusted under 35 U.S.C. 154(b) by 0 days.

(21) Appl. No.: 17/881,093

(22) Filed: Aug. 4, 2022

(65) Prior Publication Data

US 2023/0215322 A1 Jul. 6, 2023

(30) Foreign Application Priority Data

Jan. 5, 2022 (KR) ..... 10-2022-0001786

(51) Int. Cl.
*G09G 3/20* (2006.01)
*G09G 3/3233* (2016.01)

(52) U.S. Cl.
CPC ..... *G09G 3/2007* (2013.01); *G09G 3/3233* (2013.01); *G09G 2300/0819* (2013.01); *G09G 2300/0842* (2013.01); *G09G 2310/0286* (2013.01); *G09G 2320/041* (2013.01); *G09G 2320/0626* (2013.01); *G09G 2360/16* (2013.01)

(58) Field of Classification Search
CPC ..... G09G 3/2007; G09G 2320/041; G09G 2320/0626; G09G 2320/064; G09G 2360/16
See application file for complete search history.

(56) References Cited

U.S. PATENT DOCUMENTS 10,062,324 B2 8/2018 Kim et al.
10,409,544 B2 9/2019 Park et al.
2006/0202630 A1* 9/2006 Yamada ..... G09G 3/3208 315/169.2

(Continued)

FOREIGN PATENT DOCUMENTS

KR 101306138 B1 9/2013
KR 1020170051630 A 5/2017

(Continued)

*Primary Examiner* — Priyank J Shah

(74) *Attorney, Agent, or Firm* — CANTOR COLBURN LLP

(57) ABSTRACT

A display device includes a substrate, pixels on the substrate, and a driving circuit unit connected to the pixels through data lines. The driving circuit unit includes a thermistor having a resistance value which changes according to a temperature of the substrate and a register group in which set values of a dimming ratio corresponding to the temperature are stored, the driving circuit unit controls the pixels to emit light with a first luminance based on the dimming ratio when the temperature based on the resistance value is less than a minimum temperature, the driving circuit unit controls the pixels to emit light with a second luminance based on the dimming ratio when the temperature is greater than the minimum temperature and less than a maximum temperature, and the driving circuit unit stops image display of the pixels when the temperature is greater than the maximum temperature.

16 Claims, 5 Drawing Sheets

(56) References Cited

U.S. PATENT DOCUMENTS

| | | | | |
|---|---|---|---|---|
| 2009/0289965 | A1* | 11/2009 | Kurokawa | G09G 3/3406 345/101 |
| 2018/0090062 | A1* | 3/2018 | Nakamura | G09G 3/3233 |
| 2021/0241722 | A1* | 8/2021 | Wang | H01L 27/1255 |

FOREIGN PATENT DOCUMENTS

| | | | |
|---|---|---|---|
| KR | 1020170073364 | A | 6/2017 |
| KR | 1020190001094 | A | 1/2019 |
| KR | 1020210081743 | A | 7/2021 |

* cited by examiner

DISPLAY DEVICE AND DRIVING METHOD THEREOF

This application claims priority to Korean Patent Application No. 10-2022-0001786, filed on Jan. 5, 2022, and all the benefits accruing therefrom under 35 U.S.C. § 119, the content of which in its entirety is herein incorporated by reference.

BACKGROUND

1. Field

Embodiments of the invention relate to a display device and a driving method thereof.

2. Description of the Related Art

With the development of information technology, the importance of display devices, which are a connection medium between users and information, has been emphasized. Accordingly, display devices such as a liquid crystal display device, an organic light emitting display device, and the like are widely used in various fields.

SUMMARY

A display panel typically maintains its function only when used within a temperature range guaranteed by a product. When the display panel is operated at a high temperature, elements thereof may deteriorate, resulting in poor image quality and fire. In a conventional display device, a heat dissipation sheet may be attached to a display panel thereof to diffuse and dissipate heat, so that the display panel is induced to be used within the temperature range. However, in a display device including a heat dissipation sheet, it may not be guaranteed that the display panel operates within a temperature range.

Embodiments of the invention provide a display device capable of directly measuring a temperature of a substrate of a display panel and operating within a guaranteed temperature range, and a driving method thereof.

A display device according to an embodiment of the invention includes a substrate; pixels on the substrate; and a driving circuit unit connected to the pixels through data lines. In such an embodiment, The driving circuit unit includes a thermistor having a resistance value which changes according to a temperature of the substrate and a register group in which set values of a dimming ratio corresponding to the temperature are stored. In such an embodiment, the driving circuit unit controls the pixels to emit light with a first luminance based on the dimming ratio when first input grayscales are input and the temperature based on the resistance value is less than a minimum temperature, the driving circuit unit controls the pixels to emit light with a second luminance based on the dimming ratio when the first input grayscales are input and the temperature is greater than the minimum temperature and less than a maximum temperature, where the second luminance decreases as the temperature increases, and a maximum value of the second luminance nay be smaller than the first luminance, and the driving circuit unit stops image display of the pixels when the first input grayscales are input and the temperature is greater than the maximum temperature.

In an embodiment, the register group may include a first register which stores the minimum temperature; and a second register which stores the maximum temperature.

In an embodiment, the register group may further include a third register which stores a maximum dimming ratio corresponding to the minimum temperature; and a fourth register which stores a minimum dimming ratio corresponding to the maximum temperature.

In an embodiment, the register group may further include a fifth register which stores a set value for whether to use the first register, the second register, the third register, and the fourth register.

In an embodiment, the driving circuit unit may operate based on a minimum temperature default value and a maximum temperature default value when a stored minimum temperature is greater than a stored maximum temperature, and the minimum temperature default value may be less than the maximum temperature default value.

In an embodiment, the driving circuit unit may operate based on a minimum dimming ratio default value and a maximum dimming ratio default value when a stored minimum dimming ratio is greater than a stored maximum dimming ratio, and the minimum dimming ratio default value may be less than the maximum dimming ratio default value.

In an embodiment, the driving circuit unit may decrease the dimming ratio of the pixels as the temperature increases from the minimum temperature to the maximum temperature, and the dimming ratio may have a value greater than or equal to the minimum dimming ratio and less than or equal to the maximum dimming ratio.

In an embodiment, the driving circuit unit may adjust data voltages applied to the data lines to correspond to grayscales smaller than the first input grayscales as the dimming ratio decreases.

In an embodiment, the driving circuit unit may decrease an emission duty ratio of the pixels as the dimming ratio decreases.

In an embodiment, the pixels may receive emission signals corresponding to the emission duty ratio, and the emission signals may be different from data voltages applied to the data lines.

According to an embodiment of the invention, a driving method of a display device including a substrate, pixels on the substrate, and a driving circuit unit connected to the pixels through data lines, includes measuring, by the driving circuit unit, a resistance value of a thermistor in the driving circuit unit, the resistance value changing according to a temperature of the substrate; and controlling, by the driving circuit unit, luminance of the pixels based on input grayscales for the pixels, the resistance value, and set values of a dimming ratio stored in a register group in the driving circuit unit. In such an embodiment, the controlling, by the driving circuit unit, the luminance of the pixels includes controlling, by the driving circuit unit, the pixels to emit light with a first luminance based on the dimming ratio when first input grayscales are input and the temperature based on the resistance value is less than a minimum temperature, controlling, by the driving circuit unit, the pixels to emit light with a second luminance based on the dimming ratio when the first input grayscales are input and the temperature is greater than the minimum temperature and less than a maximum temperature, where the second luminance decreases as the temperature increases, and a maximum value of the second luminance is smaller than the first luminance, and stopping, by the driving circuit unit, image display of the pixels when the first input grayscales are input and the temperature is greater than the maximum temperature.

In an embodiment, the register group may include a first register which stores the minimum temperature; and a second register which stores the maximum temperature.

In an embodiment, the register group may further include a third register which stores a maximum dimming ratio corresponding to the minimum temperature; and a fourth register which stores a minimum dimming ratio corresponding to the maximum temperature.

In an embodiment, the register group may further include a fifth register which stores a set value for whether to use the first register, the second register, the third register, and the fourth register.

In an embodiment, the driving circuit unit may operate based on a minimum temperature default value and a maximum temperature default value when a stored minimum temperature is greater than a stored maximum temperature, and the minimum temperature default value may be less than the maximum temperature default value.

In an embodiment, the driving circuit unit may operate based on a minimum dimming ratio default value and a maximum dimming ratio default value when a stored minimum dimming ratio is greater than a stored maximum dimming ratio, and the minimum dimming ratio default value may be less than the maximum dimming ratio default value.

In an embodiment, the driving circuit unit may decrease the dimming ratio of the pixels as the temperature increases from the minimum temperature to the maximum temperature, and the dimming ratio may have a value greater than or equal to the minimum dimming ratio and less than or equal to the maximum dimming ratio.

In an embodiment, the driving circuit unit may adjust data voltages applied to the data lines to correspond to grayscales smaller than the first input grayscales as the dimming ratio decreases.

In an embodiment, the driving circuit unit may decrease an emission duty ratio of the pixels as the dimming ratio decreases.

In an embodiment, the pixels may receive emission signals corresponding to the emission duty ratio, and the emission signals may be different from data voltages applied to the data lines.

BRIEF DESCRIPTION OF THE DRAWINGS

The above and other features of the invention will become more apparent by describing in further detail embodiments thereof with reference to the accompanying drawings, in which.

DETAILED DESCRIPTION

Figure 1:
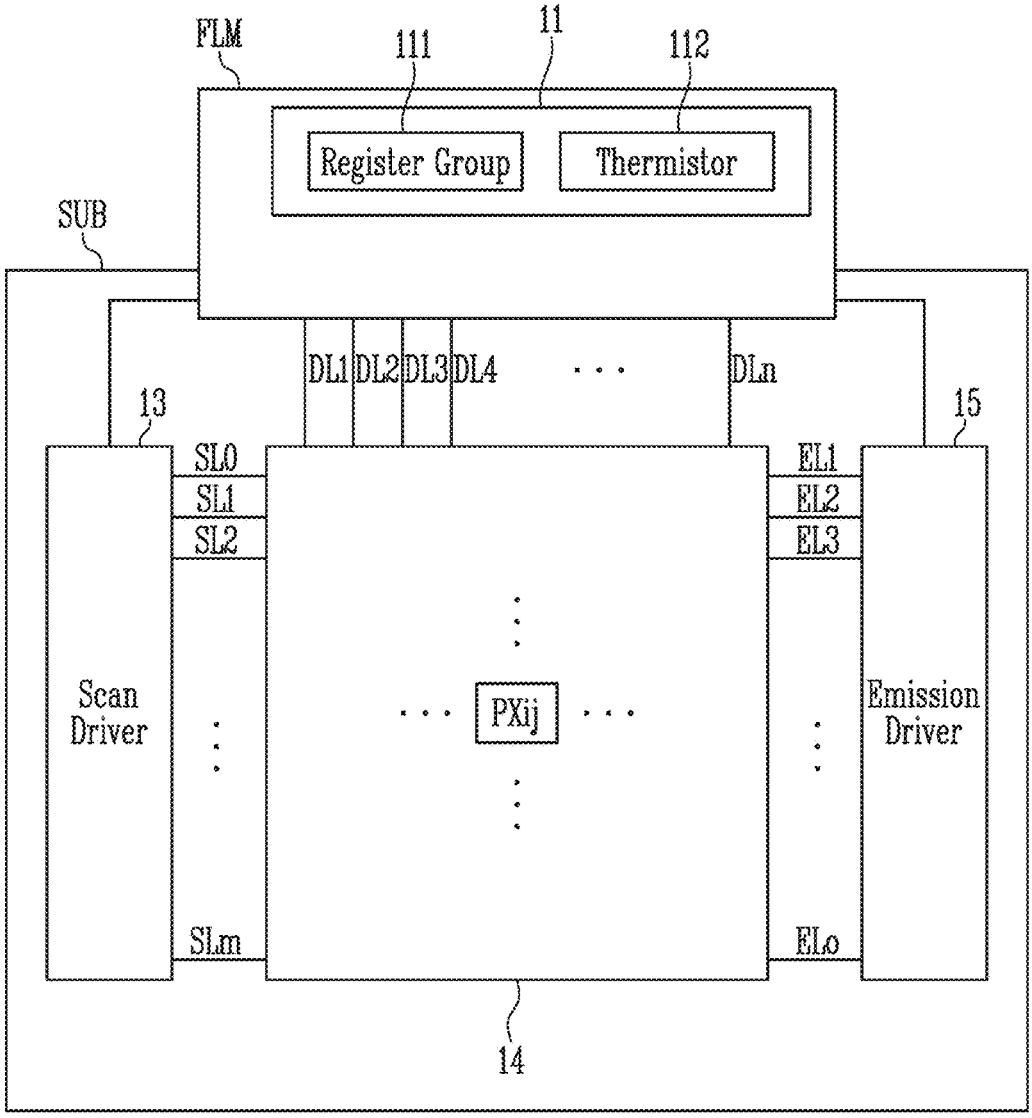
FIG. 1 is a diagram for explaining a display device according to an embodiment of the invention.

The invention now will be described more fully hereinafter with reference to the accompanying drawings, in which various embodiments are shown. This invention may, however, be embodied in many different forms, and should not be construed as limited to the embodiments set forth herein. Rather, these embodiments are provided so that this disclosure will be thorough and complete, and will fully convey the scope of the invention to those skilled in the art. Like reference numerals refer to like elements throughout.

It will be understood that when an element is referred to as being "on" another element, it can be directly on the other element or intervening elements may be present therebetween. In contrast, when an element is referred to as being "directly on" another element, there are no intervening elements present.

It will be understood that, although the terms "first," "second," "third" etc. may be used herein to describe various elements, components, regions, layers and/or sections, these elements, components, regions, layers and/or sections should not be limited by these terms. These terms are only used to distinguish one element, component, region, layer or section from another element, component, region, layer or section. Thus, "a first element," "component," "region," "layer" or "section" discussed below could be termed a second element, component, region, layer or section without departing from the teachings herein.

The terminology used herein is for the purpose of describing particular embodiments only and is not intended to be limiting. As used herein, "a", "an," "the," and "at least one" do not denote a limitation of quantity, and are intended to include both the singular and plural, unless the context clearly indicates otherwise. For example, "an element" has the same meaning as "at least one element," unless the context clearly indicates otherwise. "At least one" is not to be construed as limiting "a" or "an." "Or" means "and/or." As used herein, the term "and/or" includes any and all combinations of one or more of the associated listed items. It will be further understood that the terms "comprises" and/or "comprising," or "includes" and/or "including" when used in this specification, specify the presence of stated features, regions, integers, steps, operations, elements, and/or components, but do not preclude the presence or addition of one or more other features, regions, integers, steps, operations, elements, components, and/or groups thereof.

Furthermore, relative terms, such as "lower" or "bottom" and "upper" or "top," may be used herein to describe one element's relationship to another element as illustrated in the Figures. It will be understood that relative terms are intended to encompass different orientations of the device in addition to the orientation depicted in the Figures. For example, if the device in one of the figures is turned over, elements described as being on the "lower" side of other elements would then be oriented on "upper" sides of the other elements. The term "lower," can therefore, encompasses both an orientation of "lower" and "upper," depending on the particular orientation of the figure. Similarly, if the device in one of the figures is turned over, elements described as "below" or "beneath" other elements would then be oriented "above" the other elements. The terms "below" or "beneath" can, therefore, encompass both an orientation of above and below.

In order to clearly describe the invention, parts that are not related to the description are omitted, and the same or similar components are denoted by the same reference numerals throughout the specification. Therefore, the reference numerals described above may also be used in other drawings.

In addition, the size and thickness of each component shown in the drawings are arbitrarily shown for convenience of description, and thus the invention is not necessarily limited to those shown in the drawings. In the drawings, thicknesses may be exaggerated to clearly express the layers and regions.

Unless otherwise defined, all terms (including technical and scientific terms) used herein have the same meaning as commonly understood by one of ordinary skill in the art to which this disclosure belongs. It will be further understood that terms, such as those defined in commonly used dictionaries, should be interpreted as having a meaning that is consistent with their meaning in the context of the relevant art and the present disclosure, and will not be interpreted in an idealized or overly formal sense unless expressly so defined herein.

Hereinafter, embodiments of the invention will be described in detail with reference to the accompanying drawings.

FIG. 1 is a diagram for explaining a display device according to an embodiment of the invention.

Referring to FIG. 1, an embodiment of a display device may include a driving circuit unit 11, a scan driver 13, a pixel unit 14, and an emission driver 15. According to an embodiment, the scan driver 13, the pixel unit 14, and the emission driver 15 may be disposed or formed on a substrate SUB. According to an embodiment, the driving circuit unit 11 may be configured as or defined by parts of an integrated circuit ("IC") chip including the scan driver 13 and the emission driver 15. The driving circuit unit 11 may be configured to include a timing controller and a data driver. Referring to FIG. 1, the driving circuit unit 11 may be positioned on a film FLM, and may be electrically connected to the scan driver 13, the pixel unit 14, and the emission driver 15 through pads of the film FLM and pads of the substrate SUB.

The driving circuit unit 11 may receive input grayscales and timing signals for each frame from a processor. The processor may correspond to at least one selected from a graphics processing unit ("GPU"), a central processing unit ("CPU"), and an application processor ("AP"). The timing signals may include at least one selected from a vertical synchronization signal, a horizontal synchronization signal, and a data enable signal.

Each cycle of the vertical synchronization signal may correspond to each frame period. Each cycle of the horizontal synchronization signal may correspond to each horizontal period. Grayscales may be supplied in units of horizontal lines in each horizontal period in response to a pulse of the data enable signal. A horizontal line may mean pixels (for example, a pixel row) connected to a same scan line and a same emission line. The driving circuit unit 11 may provide a scan control signal to the scan driver 13 and an emission control signal to the emission driver 15 based on the timing signals.

The driving circuit unit 11 may be connected to pixels of the pixel unit 14 through data lines DL1, DL2, DL3, DL4, . . . , and DLn, where n may be an integer greater than 0. The driving circuit unit 11 may include a thermistor 112 having a resistance value which changes according to a temperature of the substrate SUB. The driving circuit unit 11 may control the luminance of the pixels based on the input grayscales for the pixels and the resistance value of the thermistor 112. In an embodiment, for example, the driving circuit unit 11 may control the luminance of the pixels by adjusting data voltages applied to the data lines DL1 to DLn or by adjusting an emission duty ratio of the pixels.

In an embodiment, the driving circuit unit 11 may include a register group 111. The register group 111 may store set values of a dimming ratio corresponding to the temperature determined based on the resistance value of the thermistor 112. The set values stored in the register group 111 may be changed by a user (or a manufacturer of the display device). Since detailed specifications are different for each display device, temperature increases of display devices may be different from each other. Accordingly, in an embodiment, it is desired for the user to appropriately set a temperature range and a dimming ratio range according to each display device.

The scan driver 13 may generate scan signals to be provided to scan lines SL0, SL1, SL2, . . . , and SLm by using the scan control signal (for example, a clock signal, a scan start signal, and the like) received from the driving circuit unit 11, where m may be an integer greater than 0. The scan driver 13 may sequentially supply the scan signals having a turn-on level pulse to the scan lines SL0 to SLm. The scan driver 13 may include scan stages configured in the form of a shift register. The scan driver 13 may generate the scan signals by sequentially transmitting the scan start signal in the form of a turn-on level pulse from a scan stage to a subsequent scan stage based on the control of the clock signal.

The emission driver 15 may generate emission signals to be provided to emission lines EL1, EL2, EL3, . . . , and ELo by using the emission control signal (for example, a clock signal, an emission stop signal, and the like) received from the driving circuit unit 11, where o may be an integer greater than 0. The emission driver 15 may sequentially supply the emission signals having a turn-off level pulse to the emission lines EL1 to ELo. The emission driver 15 may include emission stages configured in the form of a shift register. The emission driver 15 may generate the emission signals by sequentially transmitting the emission stop signal in the form of a turn-off level pulse from an emission stage to a subsequent emission stage based on the control of the clock signal.

The pixel unit 14 may include the pixels. Each pixel PXij may be connected to a corresponding data line, a corresponding scan line, and a corresponding emission line.

Figure 2:
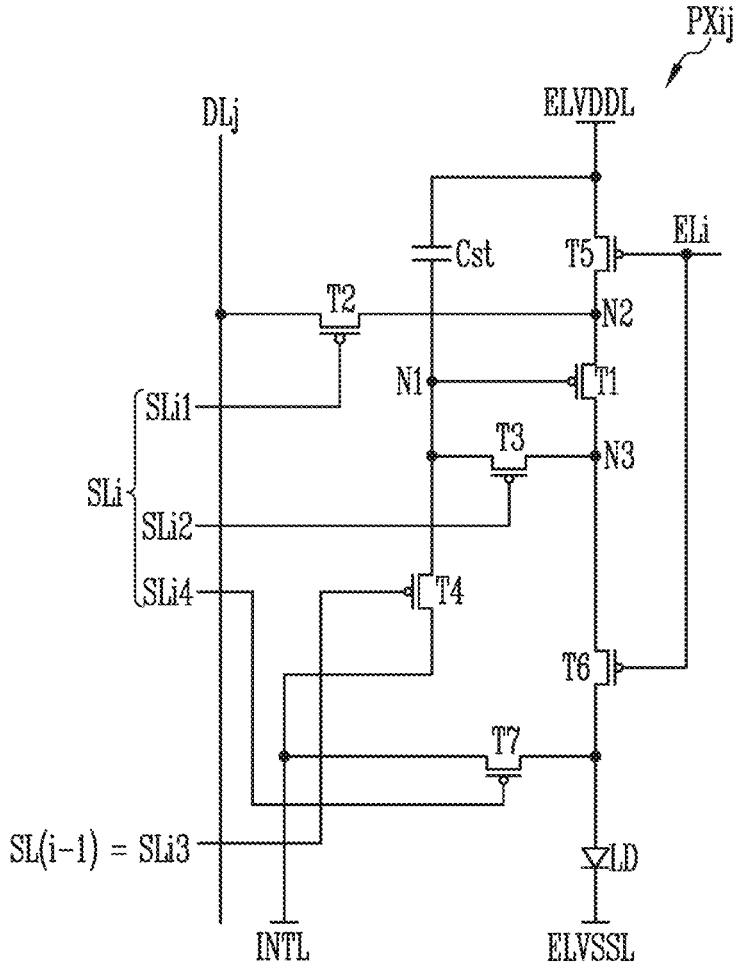
FIG. 2 is a diagram for explaining a pixel according to an embodiment of the invention.

FIG. 2 is a diagram for explaining a pixel according to an embodiment of the invention.

Referring to FIG. 2, an embodiment of the pixel PXij may include transistors T1, T2, T3, T4, T5, T6, and T7, a storage capacitor Cst, and a light emitting element LD.

Hereinafter, for convenience of description, embodiments including a circuit composed of P-type transistors will be described. However, a person skilled in the art will be able to design a circuit composed of N-type transistors by changing the polarity of a voltage applied to a gate terminal. Similarly, a person skilled in the art will be able to design a circuit composed of a combination of P-type transistors and N-type transistors. A P-type transistor may generally refer to a transistor in which the amount of current increases when a voltage difference between a gate electrode and a source electrode increases in a negative direction. An N-type transistor may generally refer to a transistor in which the amount of current increases when a voltage difference between a gate electrode and a source electrode increases in a positive direction. The transistors may be configured in various forms, such as a thin film transistor ("TFT"), a field effect transistor ("FET"), and a bipolar junction transistor ("BJT").

In an embodiment of the pixel PXij, a first transistor T1 may have a gate electrode connected to a first node N1, a first electrode connected to a second node N2, and a second electrode connected to a third node N3. The first transistor T1 may be referred to as a driving transistor.

In such an embodiment, a second transistor T2 may have a gate electrode connected to a scan line SLi1, a first electrode connected to a data line DLj, and a second electrode connected to the second node N2. The second transistor T2 may be referred to as a scan transistor.

In such an embodiment, a third transistor T3 may have a gate electrode connected to a scan line SLi2, a first electrode connected to the first node N1, and a second electrode connected to the third node N3. The third transistor T3 may be referred to as a diode-connected transistor.

In such an embodiment, a fourth transistor T4 may have a gate electrode connected to a scan line SLi3, a first electrode connected to the first node N1, and a second electrode connected to an initialization line INTL. The fourth transistor T4 may be referred to as a gate initialization transistor.

In such an embodiment, a fifth transistor T5 may have a gate electrode connected to an i-th emission line ELi, a first electrode connected to a first power source line ELVDDL, and a second electrode connected to the second node N2. The fifth transistor T5 may be referred to as an emission transistor. In an alternative embodiment, the gate electrode of the fifth transistor T5 may be connected to an emission line different from an emission line connected to a gate electrode of a sixth transistor T6.

In such an embodiment, the sixth transistor T6 may have the gate electrode connected to the i-th emission line ELi, a first electrode connected to the third node N3, and a second electrode connected to an anode of the light emitting element LD. The sixth transistor T6 may be referred to as an emission transistor. In an alternative embodiment, the gate electrode of the sixth transistor T6 may be connected to an emission line different from the emission line connected to the gate electrode of the fifth transistor T5.

In such an embodiment, a seventh transistor T7 may have a gate electrode connected to a scan line SLi4, a first electrode connected to the initialization line INTL, and a second electrode connected to the anode of the light emitting element LD. The seventh transistor T7 may be referred to as a light emitting element initialization transistor.

In such an embodiment, a first electrode of the storage capacitor Cst may be connected to the first power source line ELVDDL, and a second electrode of the storage capacitor Cst may be connected to the first node N1.

In such an embodiment, the light emitting element LD may have the anode connected to the second electrode of the sixth transistor T6 and a cathode connected to a second power source line ELVSSL. The light emitting element LD may be a light emitting diode. The light emitting element LD may include an organic light emitting diode, an inorganic light emitting diode, a quantum dot/well light emitting diode, or the like. The light emitting element LD may emit light of any one of a first color, a second color, and a third color. In an embodiment, only a single light emitting element LD is provided in each pixel, but not being limited thereto. Alternatively, a plurality of light emitting elements may be provided in each pixel. In such an embodiment, the plurality of light emitting elements may be connected in series, in parallel, or in series and parallel.

In such an embodiment, a first power source voltage may be applied to the first power source line ELVDDL, a second power source voltage may be applied to the second power source line ELVSSL, and an initialization voltage may be applied to the initialization line INTL. In an embodiment, for example, the first power source voltage may be greater than the second power source voltage. In an embodiment, for example, the initialization voltage may be equal to or greater than the second power source voltage. In an embodiment, for example, the initialization voltage may correspond to a data voltage having the smallest magnitude among data voltages that may be provided. In an alternative embodiment, for example, the magnitude of the initialization voltage may be smaller than the magnitudes of the data voltages that may be provided.

Figure 3:
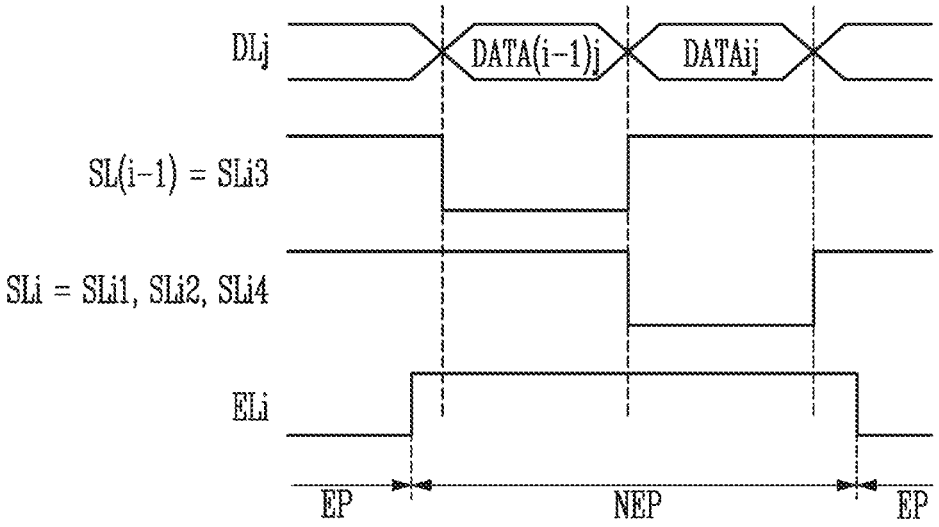
FIG. 3 is a diagram for explaining an embodiment of a method of driving the pixel of FIG. 2.

FIG. 3 is a diagram for explaining an embodiment of a method of driving the pixel of FIG. 2.

Hereinafter, for convenience of description, embodiments where the scan lines SLi1, SLi2, and SLi4 are an i-th scan line SLi, and the scan line SLi3 is an (i−1)-th scan line SL(i−1) will be described in detail. However, the connection relationship of the scan lines SLi1, SLi2, SLi3, and SLi4 may vary according to embodiments. In an alternative embodiment, for example, the scan line SLi4 may be the (i−1)-th scan line or an (i+1)-th scan line.

First, an emission signal of a turn-off level (logic high level) may be applied to the i-th emission line ELi, a data voltage DATA(i−1)j for an (i−1)-th pixel may be applied to the data line DLj, and a scan signal of a turn-on level (logic low level) may be applied to the scan line SLi3. The turn-on level of the transistor may vary depending on whether the transistor is P-type or N-type.

In this case, since a scan signal of a turn-off level is applied to the scan lines SLi1 and SLi2, the second transistor T2 may be turned off, and the data voltage DATA(i−1)j for the (i−1)-th pixel may be prevented from being applied to the pixel PXij.

In this case, since the fourth transistor T4 is turned on, the first node N1 may be connected to the initialization line INTL, and a voltage of the first node N1 may be initialized. Since the emission signal of the turn-off level is applied to the emission line ELi, the transistors T5 and T6 may be turned off, and undesired light emitting of the light emitting element LD according to the application of the initialization voltage may be prevented.

Next, a data voltage DATAij for an i-th pixel PXij may be applied to the data line DLj, and a scan signal of a turn-on level may be applied to the scan lines SLi1 and SLi2. Accordingly, the transistors T2, T1, and T3 may be turned on, and the data line DLj and the first node N1 may be electrically connected to each other. Accordingly, a compensation voltage obtained by subtracting a threshold voltage of the first transistor T1 from the data voltage DATAij may be applied to the second electrode (that is, the first node N1) of the storage capacitor Cst, and the storage capacitor Cst may maintain a voltage corresponding to a difference between the first power source voltage and the compensation voltage. This period may be referred to as a threshold voltage compensation period or a data writing period.

In an embodiment, where the scan line SLi4 is the i-th scan line, since the seventh transistor T7 is turned on, the anode of the light emitting element LD and the initialization line INTL may be connected to each other, and the light emitting element LD may be initialized with the amount of charge corresponding to a voltage difference between the initialization voltage and the second power source voltage.

Thereafter, as an emission signal of a turn-on level is applied to the i-th emission line ELi, the transistors T5 and T6 may be turned on. Accordingly, a driving current path connecting the first power source line ELVDDL, the fifth transistor T5, the first transistor T1, the sixth transistor T6, the light emitting element LD, and the second power source line ELVSSL may be formed.

The amount of a driving current flowing through the first electrode and the second electrode of the first transistor T1 may be adjusted based on the voltage maintained in the storage capacitor Cst. The light emitting element LD may emit light with a luminance corresponding to the amount of the driving current. The light emitting element LD may emit light until an emission signal of a turn-off level is applied to the emission line ELi.

When the emission signal is at the turn-on level, pixels receiving the corresponding emission signal may be in a display state. Accordingly, a period in which the emission signal is at the turn-on level may be referred to as an emission period EP (or an emission allowable period). Also, when the emission signal is at the turn-off level, pixels receiving the corresponding emission signal may be in a non-display state. Accordingly, a period in which the emission signal is at the turn-off level may be referred to as a non-emission period NEP (or an emission disallowing period).

The non-emission period NEP described in FIG. 3 may be a period for preventing the pixel PXij from emitting light with an undesired luminance during the initialization period and the data writing period. In an embodiment, one or more non-emission periods NEP may be additionally provided while data written in the pixel PXij is maintained (for example, one frame period).

The ratio of the emission period EP in one frame period may be referred to as an emission duty ratio. In an embodiment, for example, where the ratio of the emission period EP is 60% and the ratio of the non-emission period NEP is 40% in one frame period, the emission duty ratio may be 60%. As the emission period EP becomes longer and the non-emission period ENP becomes shorter, the emission duty ratio may increase. Based on a same data voltage, as the emission duty ratio increases, the emission luminance visually recognized from the pixel PXij may increase.

In an embodiment, based on a same emission duty ratio, when the first transistor T1 is configured as a P-type transistor as shown in FIG. 2, as the data voltage decreases, the emission luminance of the pixel PXij may increase. In an alternative embodiment, when the first transistor T1 is configured as an N-type transistor, as the data voltage increases, the emission luminance of the pixel PXij may increase.

Figure 4:
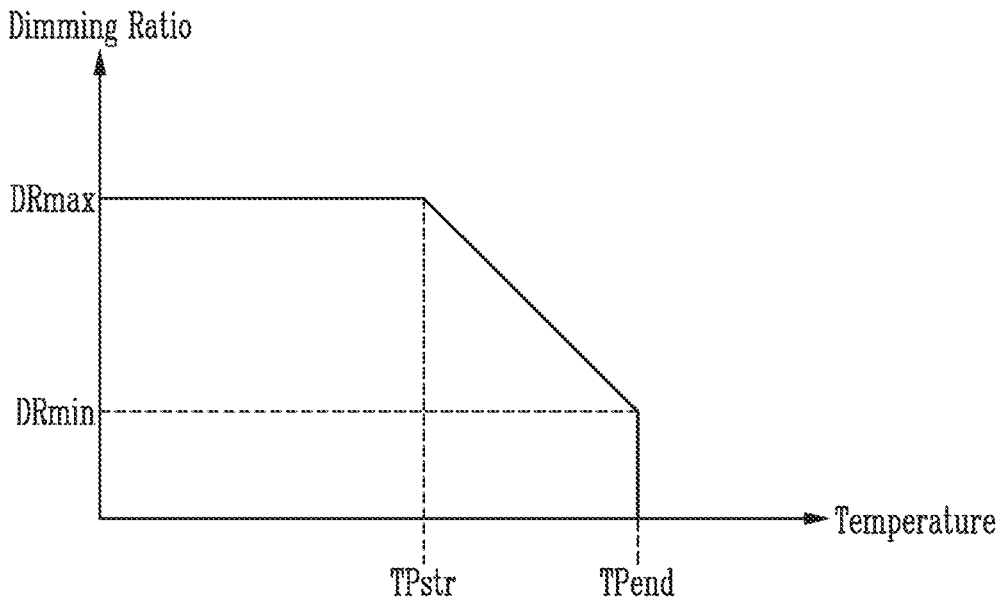
FIG. 4 is a diagram for explaining a method of controlling a temperature in the display device according to an embodiment of the invention.

FIG. 4 is a diagram for explaining a method of controlling a temperature in the display device according to an embodiment of the invention.

Based on a same input grayscales, as the dimming ratio increases, the emission luminance of the pixels may increase, and as the dimming ratio decreases, the emission luminance of the pixels may decrease. Accordingly, when the temperature of the substrate SUB increases, the driving circuit unit 11 may lower the emission luminance of the pixels to drive the display device within an appropriate temperature range (below a maximum temperature TPend). The dimming ratio may have a value greater than or equal to a minimum dimming ratio DRmin and less than or equal to a maximum dimming ratio DRmax.

In an embodiment, when the temperature determined based on the resistance value of the thermistor 112 is less than or equal to a minimum temperature TPstr, the driving circuit unit 11 may maintain the dimming ratio as the maximum dimming ratio DRmax. In an embodiment, for example, when first input grayscales (as a comparison standard, assuming input grayscales constituting a specific image frame) are input to the driving circuit unit 11 and the maximum dimming ratio DRmax is applied to the first input grayscales, the driving circuit unit 11 may control the pixels to emit light with a first luminance.

When it is determined that the temperature is higher than the minimum temperature TPstr and lower than the maximum temperature TPend, the driving circuit unit 11 may decrease the dimming ratio of the pixels as the temperature increases. In an embodiment, for example, when the first input grayscales are input to the driving circuit unit 11 and a dimming ratio smaller than the maximum dimming ratio DRmax is applied to the first input grayscales, the driving circuit unit 11 may control the pixels to emit light with a second luminance. In this case, a maximum value of the second luminance may be smaller than the first luminance.

In an embodiment, for example, when the maximum dimming ratio DRmax is applied to the first input grayscales and the pixels emit light with the first luminance, the temperature of the substrate SUB may gradually increase. In this case, when the temperature of the substrate SUB exceeds the minimum temperature TPstr, the driving circuit unit 11 may apply the dimming ratio smaller than the maximum dimming ratio DRmax to the first input grayscales. In this case, the pixels may emit light with the second luminance smaller than the first luminance. As a result, the rate of increase in the temperature of the substrate SUB may be slowed or the temperature of the substrate SUB may be decreased.

In an embodiment, when the temperature is the maximum temperature TPend, the driving circuit unit 11 may determine the dimming ratio as the minimum dimming rate DRmin. In an embodiment, for example, when the first input grayscales are input to the driving circuit unit 11 and the minimum dimming ratio DRmin is applied to the first input grayscales, the driving circuit unit 11 may control the pixels to emit light with a third luminance. In this case, the third luminance may be less than a minimum value of the second luminance.

Also, when the temperature is higher than the maximum temperature TPend, the driving circuit unit 11 may stop image display of the pixels. In an embodiment, for example, when the first input grayscales are input and the temperature is higher than the maximum temperature TPend, the driving circuit unit 11 may stop image display of the pixels. That is, when the temperature of the display device is out of an appropriate range even when the display device is driven at the minimum dimming ratio DRmin, the driving circuit unit 11 may stop image display of the pixels to prevent damage to the display device.

In an embodiment, the driving circuit unit 11 may adjust the data voltages applied to the data lines DL1 to DLn to correspond to grayscales smaller than the input grayscales (that is, grayscales corresponding to lower luminance than the input grayscales) as the dimming ratio is reduced. In an embodiment, for example, based on a same input grayscales, when the first transistor T1 is configured as the P-type transistor as shown in FIG. 2, the driving circuit unit 11 may increase the data voltages to decrease the dimming ratio. When the first transistor T1 is configured as the N-type transistor, based on the same input grayscales, the driving circuit unit 11 may decrease the data voltages to decrease the dimming ratio.

In an alternative embodiment, the driving circuit unit 11 may decrease the emission duty ratio of the pixels as the dimming ratio decreases. The pixels may receive the emission signals corresponding to the emission duty ratio, and the emission signals may be different from the data voltages applied to the data lines DL1 to DLn. In an embodiment, for example, referring to FIG. 2, the pixel PXij may receive an emission signal different from a data voltage through the emission line ELi connected to gate electrodes of the fifth transistor T5 and the sixth transistor T6. In an embodiment, for example, the driving circuit unit 11 may decrease the emission duty ratio to decrease the dimming ratio. In such an embodiment, as described above, based on one frame period, the emission duty ratio may be reduced by decreasing the emission period EP and increasing the non-emission period NEP (refer to FIG. 3). In an embodiment, a plurality of non-emission periods may be included in one frame period, and the driving circuit unit 11 may reduce the emission duty ratio by increasing the number of such non-emission periods.

Figure 5:
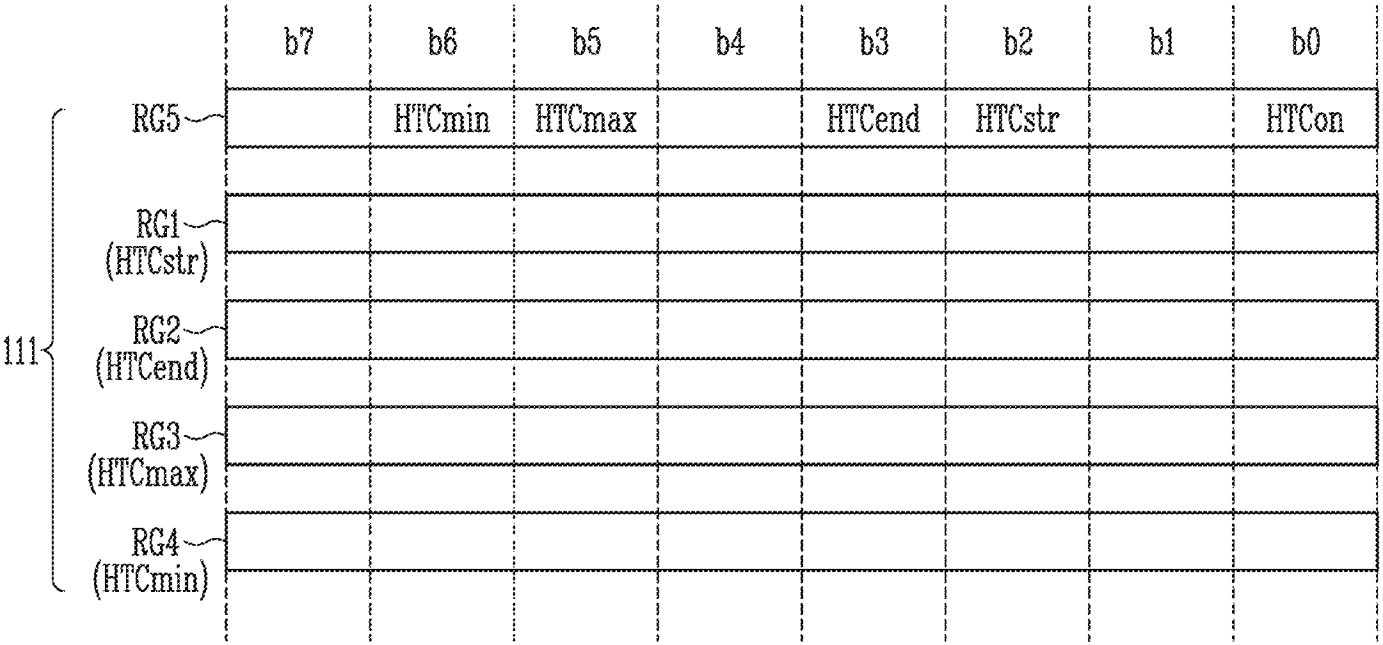
FIG. 5 is a diagram for explaining a register group according to an embodiment of the invention.

FIG. 5 is a diagram for explaining a register group according to an embodiment of the invention.

Referring to FIG. 5, the register group 111 according to an embodiment of the invention may include a first register RG1, a second register RG2, a third register RG3, a fourth register RG4, and a fifth register RG5. In an embodiment, as shown in FIG. 5, each of the first to fifth registers RG1 to RG5 has a storage of 8 bits (b0, b1, b2, b3, b4, b5, b6, and b7). Alternatively, the first to fifth registers RG1 to RG5 may have different capacities, and may have capacities less than or greater than 8 bits. This may depend on the precision or resolution of a set value to be stored in each register, and may be defined differently depending on the product. Embodiments of the invention are not limited to that shown in FIG. 5.

The fifth register RG5 may store set values for whether to use the first to fourth registers RG1 to RG4. In an embodiment, for example, a 0-th bit b0 of the fifth register RG5 may correspond to a set value HTCon for whether to use the method of controlling the temperature according to an embodiment of the invention. In an embodiment, for example, when the set value HTCon is 1, the driving circuit unit 11 may use the method of controlling the temperature described with reference to FIG. 4. In an embodiment, when a bit b0 is 0, the driving circuit unit 11 may not use the method of controlling the temperature described with reference to FIG. 4. In an embodiment, for example, the driving circuit unit 11 may maintain the dimming ratio at the maximum dimming ratio DRmax regardless of the temperature rise.

In an embodiment, for example, a second bit b2 of the fifth register RG5 may correspond to a set value HTCstr for whether to use the first register RG1. The first register RG1 may store the minimum temperature TPstr. In an embodiment, for example, the minimum temperature TPstr may be expressed by 8 bits. When the set value HTCstr is 1, the driving circuit unit 11 may use the minimum temperature TPstr stored in the first register RG1. When the set value HTCstr is 0, the driving circuit unit 11 may use a minimum temperature default value. The minimum temperature default value may be a minimum temperature at which damage to the display device is expected, and may be preset.

In an embodiment, for example, a third bit b3 of the fifth register RG5 may correspond to a set value HTCend for whether to use the second register RG2. The second register RG2 may store the maximum temperature TPend. In an embodiment, for example, the maximum temperature TPend may be expressed by 8 bits. When the set value HTCend is 1, the driving circuit unit 11 may use the maximum temperature TPend stored in the second register RG2. When the set value HTCend is 0, the driving circuit unit 11 may use a maximum temperature default value. The maximum temperature default value may be an expected maximum temperature that guarantees the operation of the display device, and may be preset.

In an embodiment, for example, a fifth bit b5 of the fifth register RG5 may correspond to a set value HTCmax for whether to use the third register RG3. The third register RG3 may store the maximum dimming ratio DRmax corresponding to the minimum temperature TPstr. In an embodiment, for example, the maximum dimming ratio DRmax may be expressed by 8 bits. When the set value HTCmax is 1, the driving circuit unit 11 may use the maximum dimming ratio DRmax stored in the third register RG3. When the set value HTCmax is 0, the driving circuit unit 11 may use a maximum dimming ratio default value. The maximum dimming ratio default value may be preset to correspond to the luminance that can be generally visually recognized by the user.

In an embodiment, for example, a sixth bit b6 of the fifth register RG5 may correspond to a set value HTCmin for whether to use the fourth register RG4. The fourth register RG4 may store the minimum dimming ratio DRmin corresponding to the maximum temperature TPend. In an embodiment, for example, the minimum dimming ratio DRmin may be expressed by 8 bits. When the set value HTCmin is 1, the driving circuit unit 11 may use the minimum dimming ratio DRmin stored in the fourth register RG4. When the set value HTCmin is 0, the driving circuit unit 11 may use a minimum dimming ratio default value. The minimum dimming ratio default value may be preset to correspond to the lowest luminance that can be visually recognized by the user.

In an embodiment, when the stored minimum temperature TPstr is greater than the stored maximum temperature TPend, the driving circuit unit 11 may operate based on the minimum temperature default value and the maximum temperature default value. The minimum temperature default value may be less than the maximum temperature default value. In such an embodiment, when the user saves the minimum temperature TPstr incorrectly even though the minimum temperature TPstr should be lower than the maximum temperature TPend, since the driving circuit unit 11 may operate based on the minimum temperature default value and the maximum temperature default value, erroneous thermal control may be effectively prevented.

In an embodiment, when the stored minimum dimming ratio DRmin is greater than the stored maximum dimming ratio DRmax, the driving circuit unit 11 may operate based on the minimum dimming ratio default value and the maximum dimming ratio default value. The minimum dimming ratio default value may be less than the maximum dimming ratio default value. In such an embodiment, when the user saves the minimum dimming ratio DRmin incorrectly even though the minimum dimming ratio DRmin should be lower than the maximum dimming ratio DRmax, since the driving circuit unit 11 may operate based on the minimum dimming ratio default value and the maximum dimming ratio default value, erroneous thermal control may be effectively prevented.

The display device and the driving method thereof according to embodiments of the invention may directly measure the temperature of the substrate of the display panel and operate within a guaranteed temperature range.

The invention should not be construed as being limited to the embodiments set forth herein. Rather, these embodiments are provided so that this disclosure will be thorough and complete and will fully convey the concept of the invention to those skilled in the art.

While the invention has been particularly shown and described with reference to embodiments thereof, it will be understood by those of ordinary skill in the art that various changes in form and details may be made therein without departing from the spirit or scope of the invention as defined by the following claims.

What is claimed is:

1. A display device comprising:

a substrate;

pixels on the substrate; and a driving circuit unit connected to the pixels through data lines, wherein the driving circuit unit includes a thermistor having a resistance value which changes according to a temperature of the substrate and a register group in which set values of a dimming ratio corresponding to the temperature are stored, wherein the driving circuit unit controls the pixels to emit light with a first luminance based on the dimming ratio when first input grayscales are input and the temperature based on the resistance value is less than a minimum temperature, wherein the driving circuit unit controls the pixels to emit light with a second luminance based on the dimming ratio when the first input grayscales are input and the temperature is greater than the minimum temperature and less than a maximum temperature, wherein the second luminance decreases as the temperature increases, and a maximum value of the second luminance is smaller than the first luminance, wherein the driving circuit unit stops image display of the pixels when the first input grayscales are input and the temperature is greater than the maximum temperature, wherein the register group includes:

a first register which stores the minimum temperature; and a second register which stores the maximum temperature, wherein the driving circuit unit operates based on a minimum temperature default value and a maximum temperature default value when a stored minimum temperature is greater than a stored maximum temperature, and wherein the minimum temperature default value is less than the maximum temperature default value.

2. The display device of claim 1, wherein the register group further includes:

a third register which stores a maximum dimming ratio corresponding to the minimum temperature; and a fourth register which stores a minimum dimming ratio corresponding to the maximum temperature.

3. The display device of claim 2, wherein the register group further includes:

a fifth register which stores a set value for whether to use the first register, the second register, the third register, and the fourth register.

4. The display device of claim 2, wherein the driving circuit unit decreases the dimming ratio of the pixels as the temperature increases from the minimum temperature to the maximum temperature, and wherein the dimming ratio has a value greater than or equal to the minimum dimming ratio and less than or equal to the maximum dimming ratio.

5. The display device of claim 4, wherein the driving circuit unit adjusts data voltages applied to the data lines to correspond to grayscales smaller than the first input grayscales as the dimming ratio decreases.

6. The display device of claim 4, wherein the driving circuit unit decreases an emission duty ratio of the pixels as the dimming ratio decreases.

7. The display device of claim 6, wherein the pixels receive emission signals corresponding to the emission duty ratio, and wherein the emission signals are different from data voltages applied to the data lines.

8. A display device comprising:

a substrate;

pixels on the substrate; and a driving circuit unit connected to the pixels through data lines, wherein the driving circuit unit includes a thermistor having a resistance value which changes according to a temperature of the substrate and a register group in which set values of a dimming ratio corresponding to the temperature are stored, wherein the driving circuit unit controls the pixels to emit light with a first luminance based on the dimming ratio when first input grayscales are input and the temperature based on the resistance value is less than a minimum temperature, wherein the driving circuit unit controls the pixels to emit light with a second lumincance based on the dimming ratio when the first input grayscales are input and the temperature is greater then the minimum temperature and less than a maximum temperature, wherein the second luminance decreases as the temperature increases, and a maximum value of the second luminance is smaller than the first luminance, wherein the driving circuit unit stops image display of the pixels when the first input grayscales are input and the temperature is greater than the maximum temperature, wherein the register group includes:

a first register which stores the minimum temperature; and a second register which stores the maximum temperature, a third register which stores a maximum dimming ratio corresponding to the minimum temperature; and a fourth register which stores a minimum dimming ratio corresponding to the maximum temperature, wherein the driving circuit unit operates based on a minimum dimming ratio default value and a maximum dimming ratio default value when a stored minimum dimming ratio is greater than a stored maximum dimming ratio, and wherein the minimum dimming ratio default value is less than the maximum dimming ratio default value.

9. A driving method of a display device including a substrate, pixels on the substrate, and a driving circuit unit connected to the pixels through data lines, the driving method comprising:

measuring, by the driving circuit unit, a resistance value of a thermistor in the driving circuit unit, wherein the thermistor has a resistance value which changes according to a temperature of the substrate; and controlling, by the driving circuit unit, luminance of the pixels based on input grayscales for the pixels, the resistance value, and set values of a dimming ratio stored in a register group in the driving circuit unit, wherein the controlling, by the driving circuit unit, the luminance of the pixels comprises:

controlling, by the driving circuit unit, the pixels to emit light with a first luminance based on the dimming ratio when first input grayscales are input and the temperature based on the resistance value is less than a minimum temperature, controlling, by the driving circuit unit, the pixels to emit light with a second luminance based on the dimming ratio when the first input grayscales are input and the temperature is greater than the minimum temperature and less than a maximum temperature, wherein the second luminance decreases as the temperature increases, and a maximum value of the second luminance is smaller than the first luminance, and stopping, by the driving circuit unit, image display of the pixels when the first input grayscales are input and the temperature is greater than the maximum temperature, wherein the register group includes:

a first register which stores the minimum temperature; and a second register which stores the maximum temperature, wherein the driving circuit unit operates based on a minimum temperature default value and a maximum temperature default value when a stored minimum temperature is greater than a stored maximum temperature, and wherein the minimum temperature default value is less then the maximum temperature default value.

10. The driving method of claim 9, wherein the register group further includes:

a third register which stores a maximum dimming ratio corresponding to the minimum temperature; and a fourth register which stores a minimum dimming ratio corresponding to the maximum temperature.

11. The driving method of claim 10, wherein the register group further includes:

a fifth register which stores a set value for whether to use the first register, the second register, the third register, and the fourth register.

12. The driving method of claim 10, wherein the driving circuit unit decreases the dimming ratio of the pixels as the temperature increases from the minimum temperature to the maximum temperature, and wherein the dimming ratio has a value greater than or equal to the minimum dimming ratio and less than or equal to the maximum dimming ratio.

13. The driving method of claim 12, wherein the driving circuit unit adjusts data voltages applied to the data lines to correspond to grayscales smaller than the first input grayscales as the dimming ratio decreases.

14. The driving method of claim 12, wherein the driving circuit unit decreases an emission duty ratio of the pixels as the dimming ratio decreases.

15. The driving method of claim 14, wherein the pixels receive emission signals corresponding to the emission duty ratio, and wherein the emission signals are different from data voltages applied to the data lines.

16. A driving method of a display device including a substrate, pixels on the substrate, and a driving circuit unit connected to the pixels through data lines, the driving method comprising:

measuring, by the driving circuit unit, a resistance value of a thermistor in the driving circuit unit, wherein the thermistor has a resistance value which changes according to a temperature of the substrate; and controlling, by the driving circuit unit, luminance of the pixels based on input grayscales for the pixels, the resistance value, and set values of a dimming ratio stored in a register group in the driving circuit unit, wherein the controlling, by the driving circuit unit, the luminance of the pixels comprises:

controlling, by the driving circuit unit, the pixels to emit light with a first luminance based on the dimming ratio when first input grayscales are input and the temperature based on the resistance value is less than a minimum temperature, controlling, by the driving circuit unit, the pixels to emit light with a second luminance based on the dimming ratio when the first input grayscales are input and the temperature is greater than the minimum temperature and less than a maximum temperature, wherein the second luminance decreases as the temperature increases, and a maximum value of the second luminance is smaller than the first luminance, and stopping, by the driving circuit unit, image display of the pixels when the first input grayscales are input and the temperature is greater than the maximum temperature, wherein the register group includes:

a first register which stores the minimum temperature;

a second register which stores the maximum temperature;

a third register which stores a maximum dimming ratio corresponding to the minimum temperature; and a fourth register which stores a minimum dimming ratio corresponding to the maximum temperature wherein the driving circuit unit operates based on a minimum dimming ratio default value and a maximum dimming ratio default value when a stored minimum dimming ratio is greater than a stored maximum dimming ratio, and wherein the minimum dimming ratio default value is less than the maximum dimming ratio default value.

* * * * *